United States Patent [19]

Carter

[11] 4,064,668

[45] Dec. 27, 1977

[54] SUPPORTING PIER WITH TIE-DOWN

[76] Inventor: Duane L. Carter, 2770 Santa Maria Way, Santa Maria, Calif. 93454

[21] Appl. No.: 486,748

[22] Filed: July 9, 1974

[51] Int. Cl.[2] ..... E02D 27/32; E02D 35/00

[52] U.S. Cl. ..... 52/295; 52/122; 52/263; 52/DIG. 11; 248/119 R; 248/188.7; 248/352

[58] Field of Search ..... 52/295, 126, 263, 146, 52/23, 149, 122, DIG. 11; 248/119 R, 357, 352, 119 R, 119 S, 351, 188.7

[56] References Cited

U.S. PATENT DOCUMENTS

| | | | |
|---|---|---|---|
| 1,242,617 | 10/1917 | Souther | 248/119 R |
| 1,727,446 | 9/1929 | Rimely | 248/119 R |
| 2,372,802 | 4/1945 | Turner | 248/500 |
| 2,519,364 | 8/1950 | Fredholm | 248/352 |
| 3,316,680 | 5/1967 | Chrastek | 52/263 X |
| 3,606,231 | 9/1971 | Kilborn | 248/357 X |
| 3,606,704 | 9/1971 | Denton | 52/126 X |
| 3,664,082 | 5/1972 | Zintel | 52/122 X |
| 3,701,507 | 10/1972 | Bell | 248/503 |
| 3,704,560 | 12/1972 | Ratliff | 52/126 X |
| 3,713,259 | 1/1973 | Tkach | 248/357 |
| 3,750,349 | 8/1973 | Deike | 52/23 |
| 3,751,866 | 8/1973 | Renchen | 52/23 X |
| 3,808,756 | 5/1974 | Cooper et al. | 52/23 |
| 3,827,665 | 8/1974 | Kistler | 52/263 X |
| 3,828,491 | 8/1974 | Koon et al. | 52/23 |
| 3,831,329 | 8/1974 | Lear | 52/126 |
| 3,837,127 | 9/1974 | McMichael et al. | 52/23 X |
| 3,838,547 | 10/1974 | Mersberger | 52/295 |

*Primary Examiner*—Leslie Braun
*Attorney, Agent, or Firm*—Harry W. Brelsford

[57] ABSTRACT

A metal supporting pier for modular houses and mobil homes rests on a solid foundation having an upwardly projecting threaded bolt. The pier has a downwardly depending threaded rod that engages the bolt, preferably by use of a turnbuckle. This tie-down structure so tightly holds the piers to the foundation that there is no lateral shifting under seismic jolt, nor is there any vertical movement. The pier, accordingly, can be used to meet the most stringent building code requirements for housing supports.

4 Claims, 8 Drawing Figures

SUPPORTING PIER WITH TIE-DOWN

This invention relates to the permanent support of structures and is particularly useful for prefabricated dwelling units such as modular housing and mobile homes.

Building codes in many areas require that modular houses and mobile homes be supported on concrete foundations. This has caused great practical difficulties and expense in placing the dwelling on the foundation. One practice has been to construct a four-sided rectangular foundation of the required size. The completed dwelling units are then hauled by truck to the site and picked up by a crane and deposited upon the foundation. Cranes of the necessary size are extremely expensive and can be economically used only when there are large numbers of dwellings being located at the same area in a relatively short period of time. This expense factor has prevented the use of cranes for a single dwelling or even two or three in the same area.

A procedure to avoid the expense of cranes has been made by building foundations open at opposite ends. A truck carrying the modular house section or mobile home is then driven through these open ends to position the housing unit over the foundations. The housing section is then jacked up to permit removal of the truck and supporting trailer or detachable wheels, and the unit is then lowered by the jack onto the foundation. Thereafter, the open end sections are completed by pouring concrete, and the foundation is then complete. This too has proved to be costly, requiring construction of foundations at two separate times and constructing parts of the foundation with the housing unit directly above it.

I have discovered a housing support that permits construction of complete foundations at one time and which eliminates the need of a crane. In summary, I construct a concrete foundation which may be substantially flush with the ground. If the ground is sloping, then the foundation is stepped. The foundation may be open in the form of a closed rectangle for each housing unit. Imbedded within the concrete and projecting several inches above it are spaced anchor bolts, threaded on their upper ends.

The foundation is now ready to receive a housing unit, and a truck drives over these flush foundations to position the housing unit over the rectangular foundation. The housing unit is next jacked sideways and lengthwise to get exact alignment over the foundations and is then elevated so that the truck and/or removable wheels can be removed.

Piers constructed in accordance with the invention are next placed over each anchor bolt. Each pier has a downwardly extending threaded rod and each rod is secured to its respective anchor bolt by a suitable coupling, such as a turnbuckle. The turnbuckle is tightened to hold the pier to the foundation. The housing unit is next lowered onto the piers, which become the permanent support for the housing unit. The structure is secured to the piers by fasteners, such as screws and bolts, or when the pier is of metal and the housing unit has a metal frame, the two can be welded together.

The drawings form an integral part of this disclosure and specification wherein.

Figure 1:
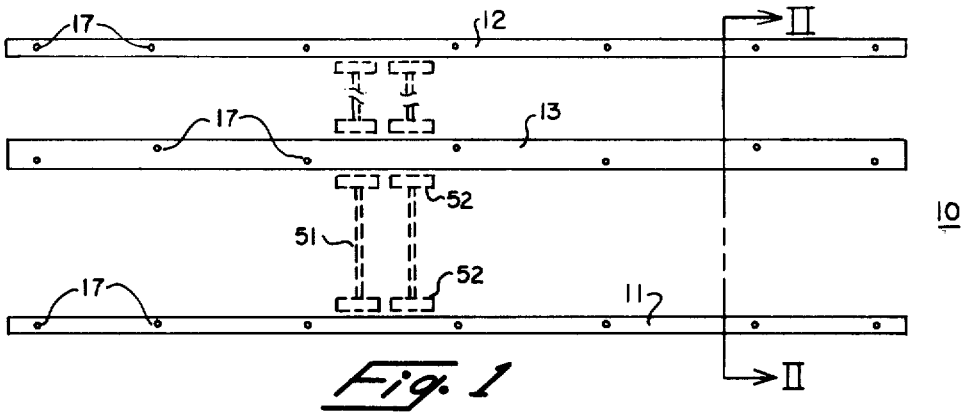
FIG. 1 is an elevation view of a foundation provided particularly in accordance with the invention and having upwardly projecting anchor bolts.

Referring to FIG. 1, there is illustrated a foundation for use in the invention in the form of three parallel grade beams 11, 13 and 12, flush with the ground grade or slightly above it. The invention will be described with reference to the support of mobile home sections, but it will be appreciated that it is fully applicable to modular home sections also. Projecting from the top of the foundation members in regular spaced position are anchor bolts 17, which may be of conventional design. The foundation may be of any desired construction, preferably reinforced concrete, and the width and depth of the foundation will depend upon the bearing characteristic of the soil and the weight of the structure to be placed on it.

Figure 2:
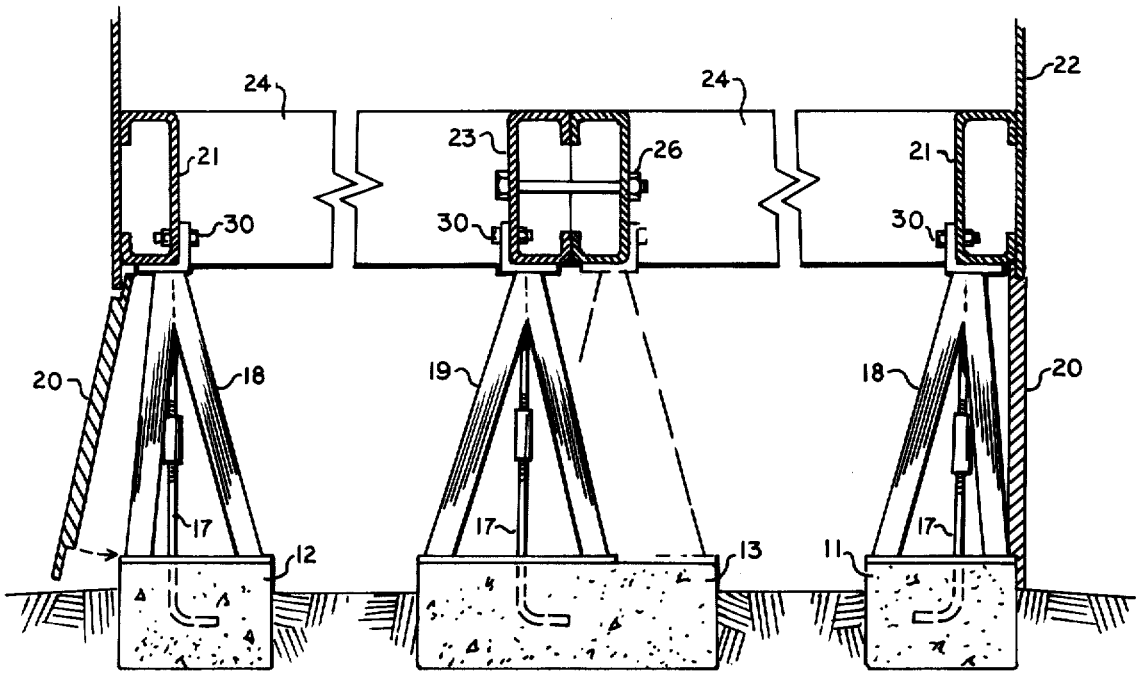
FIG. 2 is an elevation view in section along the line II—II of FIG. 1, showing the foundations and showing applied thereto support piers made in accordance with the invention, supporting the frame members of a mobile home.

Referring to FIG. 2, there is illustrated the long foundation members 11, 12 and 13, having mounted thereon piers constructed especially in accordance with the invention. Outer piers 18 are placed on the foundation sections 11 and 12 and it will be noted that one side of these piers is fairly vertical. Mounted on the center foundation section 13 are generally symmetrical piers 19. The piers 18 support outer channel members 21 of a mobile home (or modular home) 22, and the center piers 19 support channel members 23 of the inner edge of the mobile or modular home 22. Cross beams 24 connect these frame members together. Typically, a section of a mobile or modular home is twelve feet wide and these are 52 to 65 feet in length. Two such sections are joined together to form a completed mobile or modular home and suitable fasteners may be employed for this purpose, such as the nut and bolt fastener 26.

Figure 3:
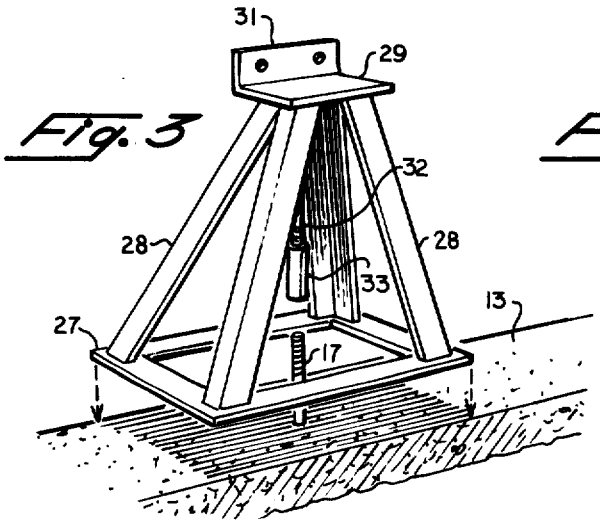
FIG. 3 is a three-dimensional view of a slightly modified form of pier shown in FIG. 2.

Referring to FIG. 3, there is illustrated a fairly symmetrical pyramidal type of pier, similar to pier 19 of FIG. 2. The pier of FIG. 3 consists of a base 27 in the form of a rectangular open frame to which are welded or otherwise secured vertical posts 28, which are inclined at their tops toward each other to form a generally pyramidal structure. The posts 28 are preferably formed of angle iron, such as steel or galvanized steel. Joining the tops together of all of the vertical posts 28 is a bearing plate 29 which may have a flange 31 on one side, through which fasteners may be passed, such as fasteners 30 of FIG. 2. In this fashion, the frames of the mobile home or modular house, as the case may be, are tightly secured to the piers.

Provided particularly in accordance with the invention is a downwardly projecting threaded rod 32 which is preferably welded to the bottom of the bearing plate 29. Screwed onto the bottom of this rod 32 is a turnbuckle 33. The whole assembly of pier and turnbuckle 33 is positioned over one of the anchor bolts 17 and the turnbuckle 33 thereupon engages the top of the anchor bolt 17. The turnbuckle 33 is manually rotated to get a threaded engagement with the anchor bolt 17, and when the turnbuckle 33 is sufficiently threaded onto the anchor bolt 17 and the downwardly projecting tension member 32, the base 27 can be fully seated on the foundation member 13. Further rotation of the turnbuckle 33 will cause it to place a tension on both the anchor bolt 17 and the downward bolt or rod 32 to compress the entire pier of FIG. 3 against the foundation 13.

The pier of FIG. 3 differs from the center pier 19 of FIG. 2, in that there is no overlapping of the angle members at the top where they engage the bearing plate. The spacing of these members or overlapping of these post members can vary according to the desired width of the bearing plate at the top of the pier.

Figure 4:
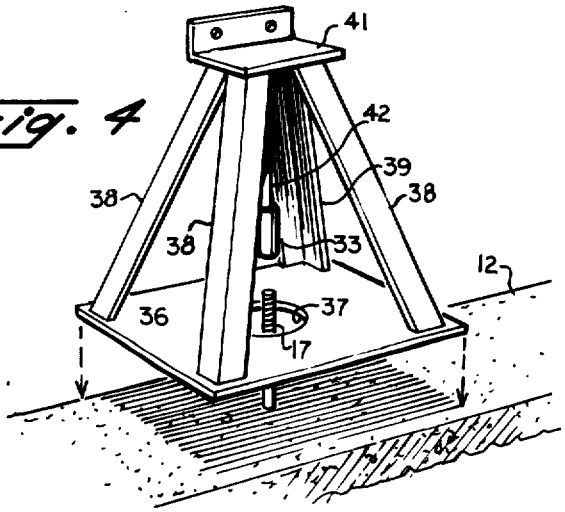
FIG. 4 is a three-dimensional view of a slightly modified form of the outer piers of FIG. 2.

Referring to FIG. 4, there is illustrated a pier which is more or less vertical on one side, such as the outer piers 18 of FIG. 2. This permits the piers to support the outer structural members of a mobile home or modular housing unit and still have a suitable vertical closure member between the house itself and the foundation underneath the house. Such a screening member is designated at 20 on each side of FIG. 2. Referring still to FIG. 4, there is illustrated a pier having a base 36 in the form of a plate with a large center aperture 37. Upwardly extending posts are secured thereto, as by welding or any other suitable mechanical fastening, and two of these posts 38 may be inclined substantially in two planes, whereas the other two upright posts 39 are inclined primarily in one plane so that the post presents a generally vertical configuration in one elevation view similar to the piers 18 of FIG. 2. The bearing plate 41 joins the posts 38 and 39 together at the top and welded or otherwise secured to this bearing plate is a downwardly projecting threaded rod 42 having a turnbuckle 33 slightly threaded on its end. As the pier is dropped over the anchor bolt 17 the turnbuckle 33 engages the anchor bolt 17 and rotation of the turnbuckle 33 permits the entire pier to be lowered until it contacts the foundation 12. Thereafter, further rotation of the turnbuckle, as by a wrench, compresses the entire pier of FIG. 4 against the foundation 12 to securely hold it in position.

Figure 8:
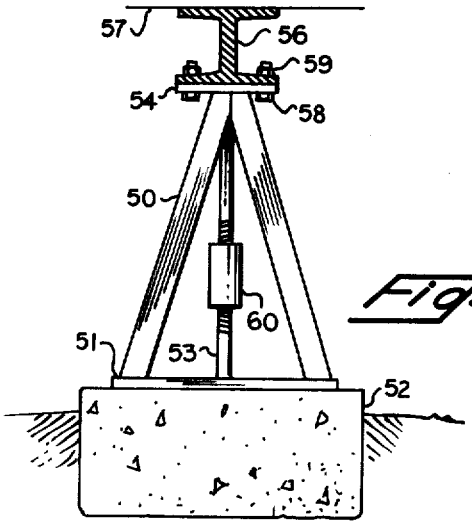
FIG. 8 is an elevation view of a modified form of pier having a flat top supporting a mobile home built on I-beam stringers.

Referring to FIG. 8, there is illustrated a modified form of the invention for supporting mobile home or modular home sections built on I-beam stringers. A symmetrical four-legged pier 50 may have a base 51 resting on a concrete foundation 52 from which projects a threaded anchor bolt 53. Formed on the top of the pier is a flat plate 54 upon which rests an I-beam 56 forming one of the longitudinal support beams or stringers for a mobile home or modular housing unit 57. The I-beam 56 is secured to the top plate 54 by suitable fasteners such as bolts and nuts 58 and 59. A turnbuckle 60 holds the pier 50 to the foundation 52.

Figure 5:
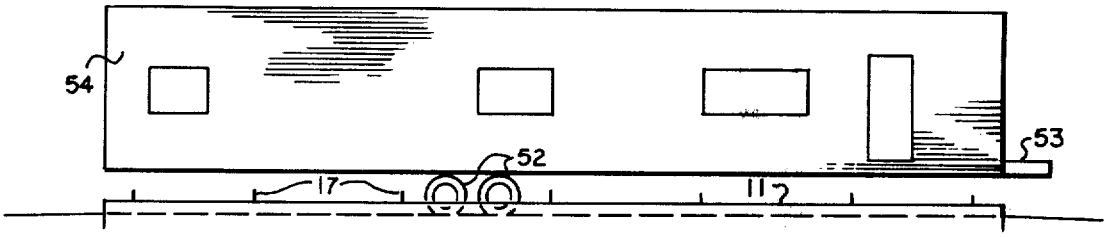
FIG. 5 is an elevation view of the foundation of FIG. 1, with a mobile home section positioned over it for installation.
Figure 6:
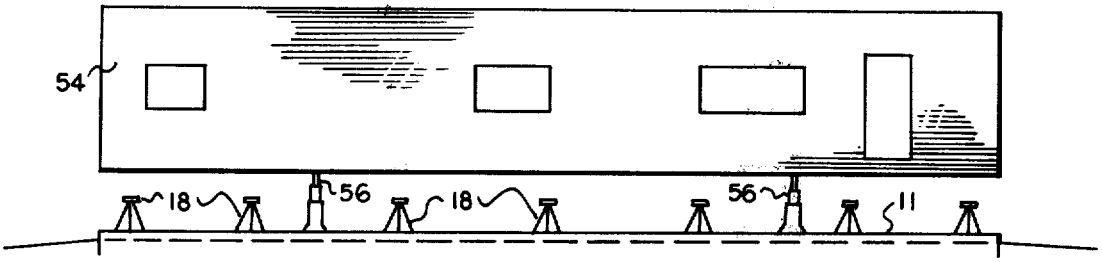
FIG. 6 is an elevation view of the foundation and mobile home of FIG. 5, wherein the mobile home has been jacked up to remove the supporting wheels and piers have been installed.

The method of utilizing the invention is illustrated in FIGS. 1, 5, 6 and 7. Referring to FIG. 1, there is illustrated in broken outline a pair of axles 51 connected to wheels 52 which are of the removable type for towing a mobile home section or a modular housing section over the highway. For this purpose, as shown in FIG. 5, a removable trailer hitch 53 may be provided. The trailer hitch 53 is connected to a mobile home section 54, and this section is pulled by the truck over the foundations by the wheels 52 fitting between the foundation members 11 and 13 and fitting between the foundation members 12 and 13. Inasumch as the foundations can be made fairly flush with the ground, the truck has little difficulty pulling the mobile home section over any end foundation members, if used. The final alignment of the mobile home section 54 of FIGS. 5 and 6 is effected by jacking the mobile home section sideways and lengthwise until it exactly fits over the foundations. The hitch 53 is removed.

Next, as shown in FIG. 6, hydraulic jacks 56 may be employed to lift the mobile home 54 sufficiently high so that the wheels 52 may be removed from underneath the mobile home. Then, the piers of FIGS. 2, 3, and 4 are placed over the anchor bolts 17 of the foundation 11 and 13 (not shown), the turnbuckles 33 tightened, as explained with reference to FIGS. 3 and 4, and then the jacks 56 are operated to lower the entire mobile home section 54 onto the piers 18 and 19, as shown in FIG. 2, but only the piers 18 show in FIG. 6, the piers 19 being hidden behind these piers 18 in that figure. Corner piers are spaced from each end. When the mobile home section 54 of FIG. 6 is lowered on the piers, then the housing section may be secured to the piers in any suitable fashion, as by the fasteners shown in FIG. 2, or by welding or screws, etc. The exact type of fastener will depend, of course, on the material of the mobile home section, and wooden frame members, for example, should be held by means of lag screws or bolts.

Figure 7:
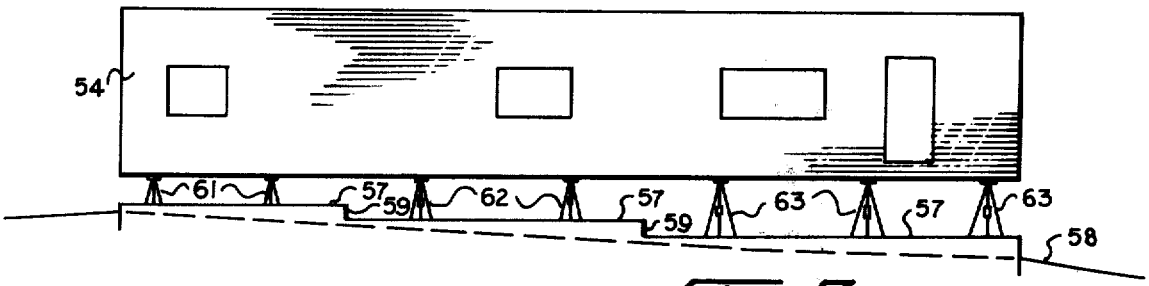
FIG. 7 is an elevation view of a foundation built on an inclined section of ground provided with piers of different heights to support a mobile home thereon in a level condition.

Referring to FIG. 7, there is illustrated the use of the invention on sloping ground. In that figure, foundation sections 57 are formed fairly close to a ground level 58 by means of steps 59. Thereafter, short piers 61 may be placed on the top step 57, intermediate heights of piers 62 may be placed on the middle step, and tall piers 63 may be placed on the lowest step. These, of course, are formed in the same general fashion as the piers illustrated in the other figures, and are held down to the foundation by means of a coupling joining a tension member in the foundation and a tension member in the top of the respective piers. The housing unit 54 may be deposited on the piers of FIG. 7 in the same fashion as described with reference to FIGS. 5 and 6.

It will be appreciated that the invention may be employed with various types of pier construction. The primary requisite of the construction is that the turnbuckle 33 of FIGS. 3, 4 and 8 be accessible to join the two tension members together. While metal is presently preferred for pier construction, other structural materials could, of course, be used. Likewise, shapes other than the angle members illustrated can be used. Couplings other than the turnbuckles 33 can be employed, but a turnbuckle is a readily available and convenient device to use. The particular structure illustrated in FIGS. 3 and 4 is extremely strong for the amount of material involved. For example, pyramids built in accordance with the symmetrical illustration of FIG. 4 were tested to failure. Each pyramid had a base one foot square, but the heights varied from twelve to twenty inches. The angle irons were three inches times three inches on the web and 3/16ths of an inch thick. The top and bottom plates were 3/16th inch steel plate. The piers twelve inches high failed at eight tons load, and the piers twenty inches high failed at nine thousand pounds.

From the foregoing, it is apparent that the piers illustrated can take a very severe tie-down stress and, in addition, have a great amount of strength left to support the building. The tie-down stress is obtained by tightening the turnbuckles 33 to a point where it would be considered a tight fit if a bolt were being tightened into metal.

In using the tie-down piers of the invention, it is important that the foundations be level. It is not important that the surface of the foundations be trowel-smooth, and it has been found that a screed smoothness is sufficient inasmuch as the small amount of roughness left from screeding the concrete forms a desirable gripping surface. If, through inadvertence, the anchorables are slightly out of location, this can be accommodated by the piers by merely bending the protruding portions of the anchor bolt and correspondingly bending the tension rods of the pier so that the alignment between the two tension members is good when the pier is positioned at the precise location that it is needed. In this connection, the open square of the base 27 of FIG. 3 and the open hole 37 of FIG. 4 accommodates large movements of this type.

The tie-down piers of the invention are especially useful where severe winds are encountered. Hurricanes and tornadoes generally smash mobile homes, especially in mobile home parks. It has been determined, however, that generally the mobile homes that are not secured to the ground sustain damage. On the other hand, mobile homes that have been secured to the ground by earth anchors have been found to sustain even less damage than conventional housing secured to foundations in the usual fashion. The wide base of the piers gives good support against lateral loads and the tie-down prevents any vertical movement. The piers of the invention thus provide substantial safety, probably superior to that of conventional house construction.

While I have described my invention with respect to specific embodiments thereof, as required by the Rules, it is not limited to these disclosures, which are illustrative only. Accordingly, all modifications and variations that fall within the true spirit of the invention are included within the scope of the following claims:

I claim:

1. A hold-down support for a building comprising:
   a. a foundation having upwardly projecting tension members;
   b. a pier supported by the foundation and having a downwardly projecting tension member secured to the pier;
   c. a building connected to the pier and supported by the pier;
   d. and a coupling engaging the foundation tension member and the pier tension member to secure the pier to the foundation and thereby act as a tie-down for the building.

2. In combination with a foundation having an upwardly projecting tension member, a pier comprising:
   a. a base;
   b. at least three posts secured to the base and having their bottom ends spaced from each other;
   c. a bearing plate secured to the top of the posts to form a tier top assembly;
   d. and a downwardly extending tension member secured to the pier top assembly, and a coupling connected the two tension members together, whereby the foundation tension member and the pier tension member are joined by the coupling to compress the pier to the foundation, said spacing of the bottom ends of the posts permitting access to the coupling area.

3. The combination set forth in claim 1 wherein the foundation tension member is threaded on at least its upper end, the pier tension member is threaded on at least its lower end, and the coupling is a turnbuckle, whereby the pier may be compressed against the foundation to thereby resist vertical and horizontal loads.

4. For supporting a structure on a foundation having an upwardly projecting threaded tension member, a pier comprising:
   a. a base;
   b. at least three posts secured to the base and having their bottom ends spaced from each other in a base shape;
   c. a bearing plate secured to the top of the posts to form a pier top assembly;
   d. and a single downwardly extending tension member that is stationary with respect to the pier top assembly and secured to the pier top assembly, extending toward the inside of the base shape and having its lower end threaded, whereby the foundation tension member and the pier tension member may be joined by a threaded coupling to hold the pier to the foundation by a compressive force, said spacing of the bottom ends of the posts permitting access to the coupling area.

* * * * *